United States Patent [19]

Daniel

[11] Patent Number: 4,899,021

[45] Date of Patent: Feb. 6, 1990

[54] LATCHING SWITCH

[76] Inventor: Thomas M. Daniel, 167 N. Taylor Ave., Norwalk, Conn. 06854

[21] Appl. No.: 185,069

[22] Filed: Apr. 22, 1988

[51] Int. Cl.[4] ..... H01H 13/62

[52] U.S. Cl. ..... 200/43.13; 200/43.16

[58] Field of Search ..... 200/43.01, 43.11, 43.16, 200/43.13, 43.18, 318, 320, 325, 328, 43.08, 43.17, 314; 70/DIG. 30; 340/542, 686

[56] References Cited

U.S. PATENT DOCUMENTS 2,091,148 8/1937 Hughes ..... 200/318

2,203,949 6/1940 Edwards ..... 200/43.13

FOREIGN PATENT DOCUMENTS 425350 2/1926 Fed. Rep. of Germany ..... 200/328

*Primary Examiner*—Henry J. Recla

*Assistant Examiner*—Glenn T. Barrett

*Attorney, Agent, or Firm*—Frank J. Thompson

[57] ABSTRACT

A portable latching switch which has a switch body containing three cavities. An elongated cavity extends into the switch body for receiving an actuating member. The second and third cavities communicate with and extend transversely from the elongated cavity and contain latching members. An electrical switching member is responsive to movement of the latching member located in the second cavity. A locking member is contained in the third cavity whereby upon actuation of the electronic device a key is required for resetting of the latching member in the third cavity and subsequently of the actuating member.

12 Claims, 2 Drawing Sheets

LATCHING SWITCH

BACKGROUND OF THE INVENTION

1. Field of the Invention

This invention relates to latching switches. The invention relates more particularly to an improved, secure, portable latching switch which latches in position and cannot be released therefrom except with a key means.

2. Description of the Prior Art

The need arises at times for a small, portable, secure mechanical latching switch which can be set manually but which cannot be reset except with a pre-arranged key means. This need frequently arises in connection with law enforcement and covert operations wherein a subject may be 'wired' for a recording or a transmitting function. In the usual situation, the subject would have on the person a portable radio transmitter or recording device with self-contained power supply and an audio pick up. At an opportune time, the subject then actuates the switch to initiate the recording.

It happens at times that the recording may be switched off during critical moments, sometimes accidentally and sometimes due to the unreliability of the subject. For this reason, it is desirable to provide a mechanical switch for actuating electronic equipment which once actuated, cannot be reset by the subject except with a key means.

SUMMARY OF THE INVENTION

Accordingly, it is an object of this invention to provide a secure, portable, mechanical latching switch for use in connection with covert operations, which is carried on the person of a subject and which the subject may actuate but, once actuated, cannot be reset by the subject except with a key means.

Another object of the invention is to provide an improved mechanical latching switch which, upon latching, can be released only with a key means.

Another object of the invention is to provide an improved latching switch.

In accordance with features of the invention, an improved latching switch includes a compact, portable switch body having an aperture formed therein and an elongated cavity extending into the body from the aperture. The elongated cavity receives a switch actuating member. A biasing means is positioned in the cavity for causing the actuating member to extend through the aperture and from the body. A second elongated cavity if formed in the body and extends transversely to the first cavity and communicates with it. A third cavity, also formed in the body, extends transversely to the first cavity an also communicates with it. Positioned in the second cavity is a first latch means which engages and restrains the actuating member at a first location at which the actuating member extends partly from the body. A second latch means is also positioned in the third cavity for engaging and restraining the actuating member at a second location at which the actuating member is substantially recessed within the first cavity. There is an electrical switch means positioned in the switch body which responds to movement of the first latch means and assumes a first switching state when the actuating member extends partly from the body and a second switching state when the actuating member is substantially recessed in the body. A key means is provided for engaging and actuating the second latch means in the third cavity in order to release the actuating member from the latched, recessed position. Upon release the biasing means within the first cavity thereby causes the actuating member to advance to a first latch position at which it extends partly from the body.

BRIEF DESCRIPTION OF THE DRAWINGS

These and other objects and features of the invention will become apparent with reference to the following specification and to the drawings wherein:

FIG. 1 is a schematic diagram illustrating an arrangement utilizing the switch 12 which is used, for example, in a covert recording procedure. A subject is 'wired' to carry each of the components hidden on his person. With this arrangement, electrical power is provided by a self contained power supply comprising a battery source 10 via a cable 11 and via a latching switch 12 to a portable cassette recorder 14. Alternativley, the arrangement may provide for a radio transmitter in place of a recorder or for both. An audio pickup 16 is also provided and coupled as a signal input to the recorder.

Figure 1:
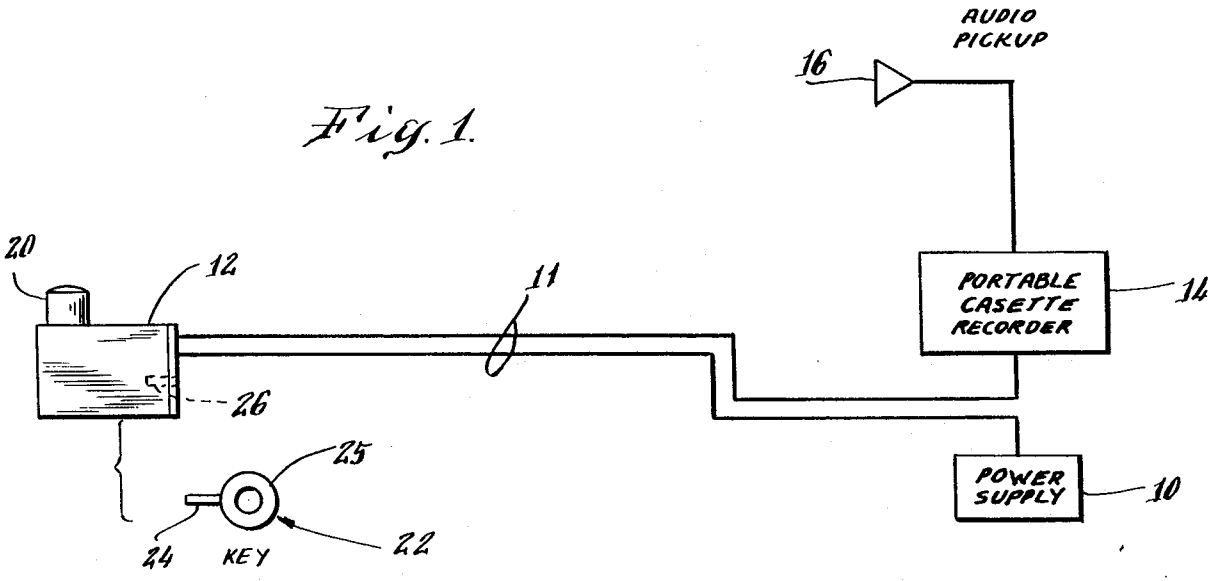
FIG. 1 is a schematic diagram illustrating the latching switch of this invention used with a cassette recorder.
Figure 2:
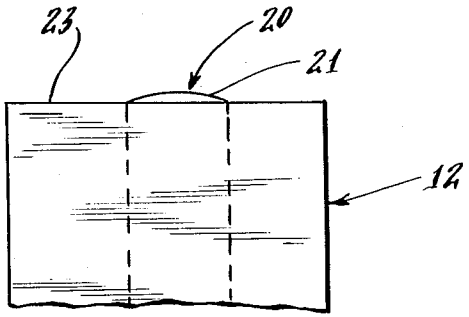
FIG. 2 is an enlarged, fragmentary view of a portion of the latching switch of FIG. 1 illustrating an actuating member in a recessed position.
Figure 5:
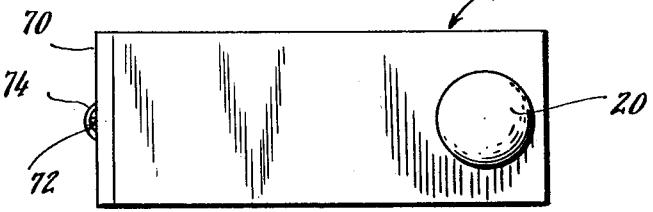
FIG. 5 is a top plan view of the latching switch of FIG. 3.

The latching switch 12 includes an actuating member comprising a pushbutton 20. When the pushbutton 20 is in an extended position as illustrated in FIG. 1, electrical contact within the latching switch (not illustrated) are "open" and power is interrupted to the portable cassette recorder. The pushbutton 20 can be easily depressed by a subject's thumb motion. When so depressed, it latches and "closes" the electrical switch contacts and applies power to the cassette recorder 14 or transmitter as the case may be thereby rendering the system operative. Upon full depression and latching, the upper surface 21 of the push button 20 becomes substantially flush with an upper surface 23 of the switch body 12, as shown in the enlarged fragmentary view of FIG. 2. Since the pushbutton 20 is latched, it cannot be accidently unlatched nor can the subject readily extract it from the body and reset the switch to the 'off' position. Upon latching, the pushbutton 20 cannot be readily retracted manually without a key means 22 which is not made available to the subject. The key means 22 may be a small tool such as an Allen wrench or it may assume other shapes for effecting the function as described. As illustrated, the key means includes a finger gripping segment 25 and an extension 24. The extension 24 which has a hexagonal cross section is inserted into a bore 26 of the body of the switch 12 and adjusts a latch means body therein, described hereinafter. This adjustment reduces a force on and enables the push button 20, which is spring biased, to once again extend to its unlatched position.

Figure 4:
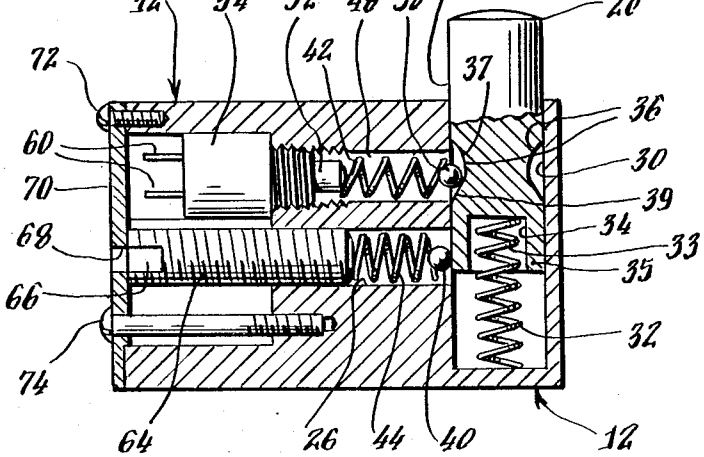
FIG. 4 is a view taken on line 4-4 of FIG. 3.
Figure 3:
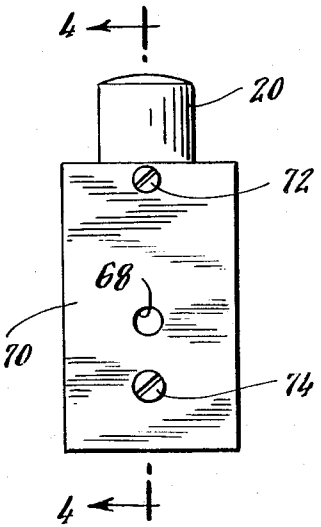
FIG. 3 is an end view of the latching switch of FIG. 1.

FIG. 4 is an enlarged, more detailed representation of the switch body 12. The arrangement provides for latching the pushbutton 20, shown to be generally cylindrically shaped, alternatively at one of two longitudinal positions. In the extended, unlatched position, the pushbutton 20 which is positioned for longitudinal travel in a first cavity shown to be a bore 30, is biased in a longitudinal direction by bias means comprising a spring 32, also positioned in the bore 30. An upper segment 33 of spring 32 is seated in a recess 34 formed in a lower segment 35 of the pushbutton 20. The pushbutton 20 is shaped to receive and engage latch bodies. In the illustrated embodiment of FIG. 4, it includes a constricted neck segment along its length, indicated by generally referenced numeral 36. The constricted neck segment 36 is adapted to engage and receive a first latch means which includes a latch body 38 positioned in a second cavity, and, a second latch means which includes latch body 40 positioned in a third cavity. These latch bodies are shown in the embodiment of FIG. 4 to comprise spheres 38 and 40. The spheres 38 and 40 engage and latch the pushbutton 20 at different locations of the pushbutton's longitudinal travel. Neck segment 36 includes a curved segment 37 which extends to an adjacent collar segment 39 of the pushbutton body 20. The first latch means further includes a bias means comprising a spring 42, which biases the sphere 38 toward pushbutton 20 and latches the pushbutton 20 at a first location at which the pushbutton extends from the body 12. Sphere 38 engages the collar 39 and inhibits further axial travel and escape of the pushbutton 20 from the body of switch 12. The second latch means further includes a bias means comprising a spring 44 which biases sphere 40 in a direction toward the pushbutton 20 and latches the pushbutton 20 at a second location in the first cavity at which the pushbutton is substantially recessed in the body 12. As the pushbutton 20 is depressed by finger force of the user against the force of the spring 32, the curved segment 37 and a rectilinear wall segment 46 of the pushbutton 20 engage sphere 38 in sequence thereby forcing the sphere to retract into the second cavity comprising a bore 48 and enabling the pushbutton body to advance longitudinally toward a recessed part of the bore 30. As the neck segment 36 aligns with the third cavity, shown to be a bore 26, the sphere 40 of the second latch means engages the constricted neck segment 36 and in particular the collar 39 and thus retains and latches the pushbutton 20 at a second recessed location.

As the pushbutton 20 is being depressed, its curved segment 37 and rectilinear segment 46 exert in sequence a lateral force on the sphere 38 against the spring 48, as indicated, which in turn exerts a lateral force on a movable electric switch actuating member comprising a pushbutton 52 of a cylindrical shaped electrical microswitch 54. The body of the microswitch 54 is screw-threaded in the bore 48. Internal switch contacts of microswitch 54 (not shown) are thereby actuated to a 'closed' position thus extablishing electrical continuity between terminals 60. Terminals 60 of microswitch 54 are coupled to the cable 11 (FIG. 1) for applying electric potential from the power supply 10 and through the 'closed' switch contacts to the cassette recorder 14. In this manner, the microswitch 54 responds to movement of the latch means in the second cavity and thus to the position of the pushbutton 20.

When the pushbutton 20 is in its second recessed position, the sphere 40 is biased by the compressed helical spring 44 against the recessed neck segment 36 of the pushbutton 20. The second latch means further includes a latch body 64. Compression of spring 44 and the force of the applied bias is established by the position of an adjustable latch body comprising a setscrew 64 located in bore 26. Rotating setscrew 64 clockwise, as viewed from the left end of the switch in FIG. 4 advances the setscrew to the right as viewed in FIG. 4 and increases the force. Conversely, rotating the set screw counterclockwise retracts the setscrew toward the left as viewed in FIG. 4 and decreases the bias force. In the recessed position, the detenting force applied by setscrew 64, compressed spring 44 and sphere 40 is greater than the force applied to the pushbutton 20 by spring 32 and the pushbutton will remain captivated in this attitude.

The manner by which the pushbutton 20 can be released from this second recessed, latched position is to rotate setscrew 64 counterclockwise as described in order to reduce the bias force on it. At some axial position of the setscrew 64, the bias force exerted by the spring 32 on the pushbutton 20 will overcome the lateral bias force applied by the sphere 40 to the neck segment 36. At this point, the pushbutton 20 will ascend to its entended position. Sphere 38 can then advance to the right as viewed in FIG. 4 and engage the constriction of pushbutton 20. Consequently, the force on the electrical actuating member 52 is decreased enabling it to advance to the right as viewed in FIG. 4 thereby resulting in an 'opening' of the contacts of microswitch 54 and interruption of continuity between terminals 60. The application of electrical power to the recorder is thereby disabled.

For adjusting the position of setscrew 64, a recess 66 is formed in a distal end which is configured to receive the hexagonal extension 24 of the key 22 (FIG. 1). Extension 24 is introduced through an aperture 68 in a cover plate 70 to the bore 26 of the switch body for making the adjustment. Generally, the extension 24 has a hexagonal cross section such as is provided by an Allen wrench but other key arrangements are intended within the scope of the invention. The recess 66 is adapted to receive and engage it. By introducing the extension 24 through the aperture 68 and into recess 66 and by rotating the setscrew, the force which the sphere 40 applies to the pushbutton 20 can be adjusted, as indicated. Screws 72 and 74 are provided for mounting the cover plate 70 to the switch body. There is also provided a wire cable guide body, not illustrated, which is used for dressing the direction of the wire (not shown in FIG. 4) from an entrance aperture (not shown) to the terminals 60.

The constriction along the length of the pushbutton 20 as illustrated in FIG. 4 includes, as described hereinbefore, the curved segment 37 which extends to the collar segment 39 and which engage the spheres 38 and 40 alternatively in the extended and recessed positions of the pushbutton 20. Although the pushbutton 20 could not be removed from the body 12 by manual finger force or pressure, it is possible that a tool might be forced between it and the switch body to remove the pushbutton.

Figure 6:
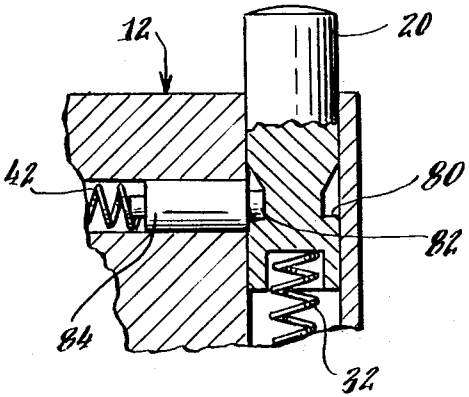
FIG. 6 is a fragmentary view, in section, illustrating an alternative arrangement of the latching switch of FIG. 4. DETAILED DESCRIPTION

FIG. 6 illustrates an alternative positive-lock embodiment. In FIG. 6 reference numerals relating to similar members in FIG. 4 are the same as in FIG. 4. The pushbutton 20 of FIG. 6 includes a shoulder 80 as distinguished from the collar 39 along its length. This ledge type of recess engages a cylindrical segment 82 of a latched body 84. The latched body 84 performs the same functions as the latch body sphere 38 of FIG. 4. A positive lock is thereby established which inhibits removal of the pushbutton 20 without virtually destroying the device.

In the preferred arrangement, the latch body is formed of aluminum to provide a desired light weight. Similarly, the pushbutton is also fabricated of an aluminum while the spheres 38 and 40 are formed of a harder metal such as steel. Where appropriate, polymer plastic may be substituted for the various members of the switch, depending on the particular application. It can be made conveniently compact. One such arrangement fabricated by the applicant has outside switch body dimensions of about 1 3/16 inches in length, ¾ inch in height and ⅜ inches in width. This relatively small size and its accompanying light weight render the switch particularly useful for portable use as described. The features are also beneficial for stationary applications. The latching arrangement described renders the switch immune to drop-out or reset by power interruptions. It is substantially immune to false triggering which might result from electromagnetic or electrostatic interference. The switch itself provides a reliable visual indication of its state by virture of the position of the pushbutton 20.

An improved, secure, compact, light weight switch has thus been described which renders covert recording and transmitting procedures relatively more secure and reliable. It is further advantageous in that it can be conveniently be set by a user's finger force but cannot be readily reset without a key means.

While I have described particular embodiments of my invention, it will be apparent to those skilled in the art that variations may be made thereto without departing from the spirit of the invention and the scope of the appended claims.

What is claimed is:

1. An improved latching switch, comprising:

(a) A portable switch body having an aperture formed therein and a first elongated cavity extending into said body from said aperture for receiving a switch actuating member therein;

(b) a switch actuating member positioned in said cavity and adapted for movement along a length of said cavity;

(c) a biasing means positioned in said cavity for causing said actuating member to extend through said aperture and from said body;

(d) a second elongated cavity formed in said body, said second cavity communicating with said first cavity and extending transversely thereto;

(e) a third elongated cavity formed in said body, said third cavity communicating with said first cavity and extending transversely thereto;

(f) a first latch means movably positioned in said second cavity for engaging and restraining said actuating member at a first location of said actuating member at which location said actuating member extends partly from said switch body;

(g) a second latch means movably positioned in said third cavity for engaging and restraining said actuating member at a second location of said actuating member at which location said actuating member is substantially recessed within said first cavity;

(h) an electrical switching means positioned in said switch body and responsive to movement of said first latch means in said second cavity for providing a first switching state when said switch actuating member is positioned at said first location and a second switching state when said switch actuating member is moved from said first location and is positioned at said second location; and, (i) a key means for engaging and actuating said second latch means for releasing said latched actuating member from its second location whereby said biasing means causes said actuating member to advance to said first location in said first cavity at which it extends partly from said body.

2. The latching switch of claim 1 wherein said first cavity comprises a bore and said actuating member comprises an elongated, generally cylindrically shaped body having a recess formed therein for alternativley receiving and engaging said first latch menas of said second cavity and said second latch means of said third cavity.

3. The latching switch of claim 2 wherein first latch means of said second cavity comprises a first latch body configured to engage said actuating member recess and means for baising said latch body in a direction toward said actuating member.

4. The latching switch of claim 3 wherein said second latch means of said third cavity includes a second latch body configured to engage said actuating member recess and means for biasing said latch body in a direction toward said actuating member.

5. The latching switch of claim 4 wherein said second latch means of said third cavity includes a third body adapted to be adjustably repositioned in said third cavity and to adjust a bias force on said latch body.

6. The latching switch of claim 5 wherein said third cavity is internally threaded, said third latch body is externally threaded for longitudinal movement within said third cavity and includes means for receiving said key means for adjusting the position of said third latch body in said third cavity.

7. the latching switch of claim 3 wherein said first latch body is spherically shaped and said biasing means comprises a spring biasing means.

8. The latching switch of claim 4 wherein said latching body is spherically shaped and said biasing means comprises a spring biasing means.

9. The latching switch of claim 1 wherein said electrical switching means includes a movable actuating member which engages said first latch means of said second cavity and said switch actuating member is actuated by movement of said first latch means in said second cavity.

10. The latching switch of claim 1 including a second aperture for providing entrance of said key means into said body to engage said second latch means of said third cavity.

11. The latching switch of claim 3 wherein said recess of said actuating member includes a shoulder segment extending transversely to said first cavity for engaging said first latch body.

12. The latching switch of claim 1 wherein said first latch body includes a cylindrically shaped segment for engaging said shoulder segment.

* * * * *